US007322361B2

(12) United States Patent
Grzonka et al.

(10) Patent No.: US 7,322,361 B2
(45) Date of Patent: Jan. 29, 2008

(54) METHOD FOR SUPPLYING A FLOWABLE MEDIUM TO THE TOBACCO OF A SMOKING PRODUCT

(75) Inventors: Horst Grzonka, Mistelgau (DE); Heiko Hertrich, Bayreuth (DE)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 660 days.

(21) Appl. No.: 10/813,316

(22) Filed: Mar. 30, 2004

(65) Prior Publication Data

US 2004/0182405 A1 Sep. 23, 2004

Related U.S. Application Data

(62) Division of application No. 10/040,072, filed on Oct. 23, 2001, now Pat. No. 6,745,778.

(30) Foreign Application Priority Data

Oct. 23, 2000 (DE) ..... 100 52 408

(51) Int. Cl.
*A24B 15/00* (2006.01)
*A24B 15/28* (2006.01)

(52) U.S. Cl. ..... 131/309; 131/300; 131/280; 131/285; 141/284

(58) Field of Classification Search ..... 131/309, 131/300, 280; 141/280, 284
See application file for complete search history.

(56) References Cited

U.S. PATENT DOCUMENTS

| | | | | |
|---|---|---|---|---|
| 2,250,452 | A * | 7/1941 | Alm | 131/255 |
| 2,333,049 | A * | 10/1943 | Shapiro | 131/300 |
| 3,545,453 | A * | 12/1970 | Hoffman | 131/300 |
| 3,732,872 | A * | 5/1973 | Lakritz | 131/300 |
| 3,837,378 | A | 9/1974 | Kanki et al. | |
| 3,847,162 | A | 11/1974 | Seil | |
| 3,873,378 | A * | 3/1975 | Webster | 148/325 |
| 4,120,309 | A * | 10/1978 | Brantl et al. | 131/329 |
| 4,233,995 | A * | 11/1980 | Kotuby et al. | 131/300 |
| 4,966,170 | A | 10/1990 | Keritsis et al. | |

FOREIGN PATENT DOCUMENTS

| | | | |
|---|---|---|---|
| DE | 632490 | A1 * | 7/1936 |
| DE | 2 322 162 | | 11/1973 |
| GB | 2 191 380 | A1 | 12/1987 |

OTHER PUBLICATIONS

Machine translation of German Patent DE 632,490, Accessed on EPO website Mar. 14, 2007.*

* cited by examiner

*Primary Examiner*—Steven P. Griffin
*Assistant Examiner*—Jason Lazorcik
(74) *Attorney, Agent, or Firm*—Charles I. Sherman; Middleton Reutlinger

(57) ABSTRACT

The invention relates to a method for supplying a flowable medium to the tobacco rod of a smoking product, wherein the medium is introduced on a drum (1) of a cigarette machine, after the tobacco rod is formed.

35 Claims, 5 Drawing Sheets

METHOD FOR SUPPLYING A FLOWABLE MEDIUM TO THE TOBACCO OF A SMOKING PRODUCT

"This present application is a divisional patent application of and claims priority to and benefit of, U.S. patent application Ser. No. 10/040,072 filed Oct. 23, 2001 now U.S. Pat. No. 6,745,778, which claims priority to and benefit of German Patent Application No. 100 52 408.7, filed Oct. 23, 2000."

BACKGROUND OF THE INVENTION

The present invention relates to a method for supplying a flowable medium to the tobacco of a smoking product.

Supplying flowable media, such as flavor, to smoking products is carried out in many different ways in the prior art. Mostly, in this respect, a special flavor drum is provided in tobacco preparation, into which tobacco is introduced and in which flavor is added to said tobacco, after which it is transported to the production machine in order to produce the tobacco rod.

DE 198 44 682 shows a method wherein the tobacco is sprayed with flavor by means of a nozzle while the rod is being formed; U.S. Pat. No. 4,619,276, DE 38 21 677 and EP 0 588 447 show similar methods. Methods and devices are also known by which the consumer can inject flavor into individual cigarettes, for example from AT 17823, UK 262003, U.S. Pat. No. 3,732,872 and WO 98/02053.

Furthermore, injecting flavor into a multitude of pre-positioned cigarettes, even through the packaging, is known from U.S. Pat. No. 3,847,162. Moreover, it is sometimes common to include menthol flavor in the cigarette packet together with the finished cigarettes, for example on the inner lining.

All the prior art has the disadvantage that it either isn't suitable for the mass production of cigarettes, such as for example the end consumer individually injecting media by means of hollow mandrels, or too great a portion of the flavor used is lost in stages of production after the flavor has been provided because of the very high volatility of the flavor material, such that flavor material is essentially wasted.

It is an object of the present invention to provide a method for supplying a flowable medium to the tobacco of a smoking product, by which the above-mentioned disadvantages in the prior art are overcome. In particular, the volatility arising after the medium is supplied is to be minimized in a factory manufacturing method for smoking products, and consumption of the medium thus reduced during manufacture.

This object is solved in the method in accordance with the invention by the medium being introduced on a drum of a cigarette machine, after the rod is formed.

In other words, the flowable medium is introduced in accordance with the invention at a very late point in the mechanical course of manufacturing the smoking product, at the point where the smoking product is already lying on drums, isolated from the other smoking products. This introduction of the medium very late in the course of production ensures that the smoking products are placed in their final packaging very soon after the flavor is supplied, such that the medium has less time in total to evaporate. This also requires a smaller quantity of the medium, and the corresponding savings precipitate large cost advantages in mass production.

The flowable medium can be introduced as a liquid, pasty, powdery, filiform, or gaseous medium. In particular, one embodiment of the present invention foresees introducing the flowable medium into the rod of the smoking product, in particular a cigarette, by means of a hollow mandrel. In this way, it is possible to insert the hollow mandrel into the front end of the smoking product, and to discharge the medium out of the hollow mandrel while withdrawing it from the rod. In principle, the medium may also be discharged while inserting the hollow mandrel. If the smoking product is a filter cigarette, the hollow mandrel is inserted up until just in front of the filter, and then withdrawn. In this respect, it is advantageous to move the hollow mandrel at a uniform speed with respect to the rod when introducing the medium, in order to enable distribution of the medium over the rod, in particular a uniform distribution of the medium over the length of the rod.

In other embodiments of the method in accordance with the invention, the medium is introduced on an already available or additional drum of the filter assembler of the cigarette machine. If an already available drum of the filter assembler is used, providing a separate drum is advantageously unnecessary, and space allowing, the medium should be supplied in accordance with the invention on such an already available drum. If the proportions of space on the cigarette machine do not permit this, then providing an additional drum can ensure that the working environment of the cigarette machine is not too seriously obstructed.

In another embodiment of the present invention, the hollow mandrel is held, in particular together with other hollow mandrels, on a carrier drum or section of a carrier drum rotating synchronously with the drum.

In another embodiment of the method in accordance with the invention, the hollow mandrel, which may be provided with screw-like outer grooves, is inserted into and extracted from the rod with auto-rotation, with auto-rotation in opposite directions for inserting and extracting. This counteracts the tobacco stick compacting when the hollow mandrel is inserted (rimming effect) and the tobacco stick loosening when the hollow mandrel is extracted (end outage).

The flowable medium can be supplied to the hollow mandrel and/or rod by means of the rotational centrifugal forces of the rotating carrier drum, or by means of a pump. In principle, the two methods of supply cited may also be used in combination. The flow of the medium may be regulated by means of a valve/control means.

According to the method in accordance with the invention, the device for supplying a flowable medium is characterized in that it comprises a means by which the medium is introduced on a drum of the cigarette machine, after the rod has been formed. This device also has the advantages described above. It preferably comprises a hollow mandrel, by means of which the flowable medium is introduced into the rod of the smoking product, in particular a cigarette, and preferably by inserting the hollow mandrel into the front end and discharging the medium while withdrawing the hollow mandrel from the rod. In order to move the hollow mandrel in this way, an axial movement means is provided in an advantageous embodiment, which moves the hollow mandrel at a uniform speed with respect to the rod when introducing the medium, allowing the medium to be distributed over the rod.

When introducing the medium, an already available or additional drum of the filter assembler of the cigarette machine may be used as a holding means for the smoking product, as has already been explained by way of the method in accordance with the invention, wherein again the possibility likewise exists of using a carrier drum or a section of a carrier drum (segment), rotating synchronously with the drum, as a holding device for the hollow mandrel, in particular also for other hollow mandrels.

In one embodiment, the axial movement means comprises a sliding part on which the hollow mandrel may slide axially when being inserting into or extracted from the rod, wherein the axial movement is generated via an inclined plate, in particular a cam plate, on which a running bearing connected to the sliding part runs off. In this way, the rotational movement of the drum may be harnessed using relatively simple means, and translated into an axial movement for the hollow mandrel. If the plate is formed as a cam plate, an influence can still be brought to bear in this respect on the speeds at which the hollow mandrel is inserted into and extracted from the rod, in such a way that for example a rapid insertion and a uniform, slower extraction are ensured, wherein the medium is then introduced uniformly.

The device in accordance with the invention may further comprise a rotating means with which the hollow mandrel, which may be provided with screw-like outer grooves, is provided with auto-rotation when it is inserted into the rod and extracted from it. In particular here, opposing auto-rotation is generated when inserting and extracting. The advantages of said auto-rotation have already been described above. It can be realized by the rotating means comprising a rotating bearing for a take-up volume, to which the hollow mandrel is fastened, as well as toothed wheels on the circumference of the take-up volume which mesh with respective tooth meshings and effect the respective auto-rotation when the hollow mandrel is moved axially.

In order to realize supply of the medium to the hollow mandrel, the device may comprise a supplying means which conveys the flowable medium by means of the rotational centrifugal forces of the rotating carrier drum. This may be constructively realized in such a way that the supplying means comprises a conduit centered on the rotational axis of the carrier drum, said conduit feeding the respective take-up volumes and/or hollow mandrels with the medium via radially arranged, rotating feed lines. In principle, the medium may of course also or additionally be supplied by means of a pump, and there exists the possibility in either case of regulating the flow of the medium using a valve/control means.

In an embodiment, the number of hollow mandrels simultaneously introducing the medium can substantially correspond to the number of smoking products held on the drum, while in a different embodiment it is equally possible for the number of hollow mandrels simultaneously introducing the medium to correspond to a portion of the number of smoking products held on the drum and for the medium to be introduced sequentially into respectively successive partial quantities of the smoking products.

In accordance with a further embodiment of the present invention, the device comprises an axial and radial movement means which translates the machine-drive movement into rotational, inserting and extracting movement by means of drive pulleys and cornering.

BRIEF DESCRIPTION OF THE DRAWINGS

The invention is explained in more detail in the following, by way of embodiments and with the aid of the enclosed drawings, in which.

DETAILED DESCRIPTION OF THE PREFERRED EMBODIMENTS

Figure 1:
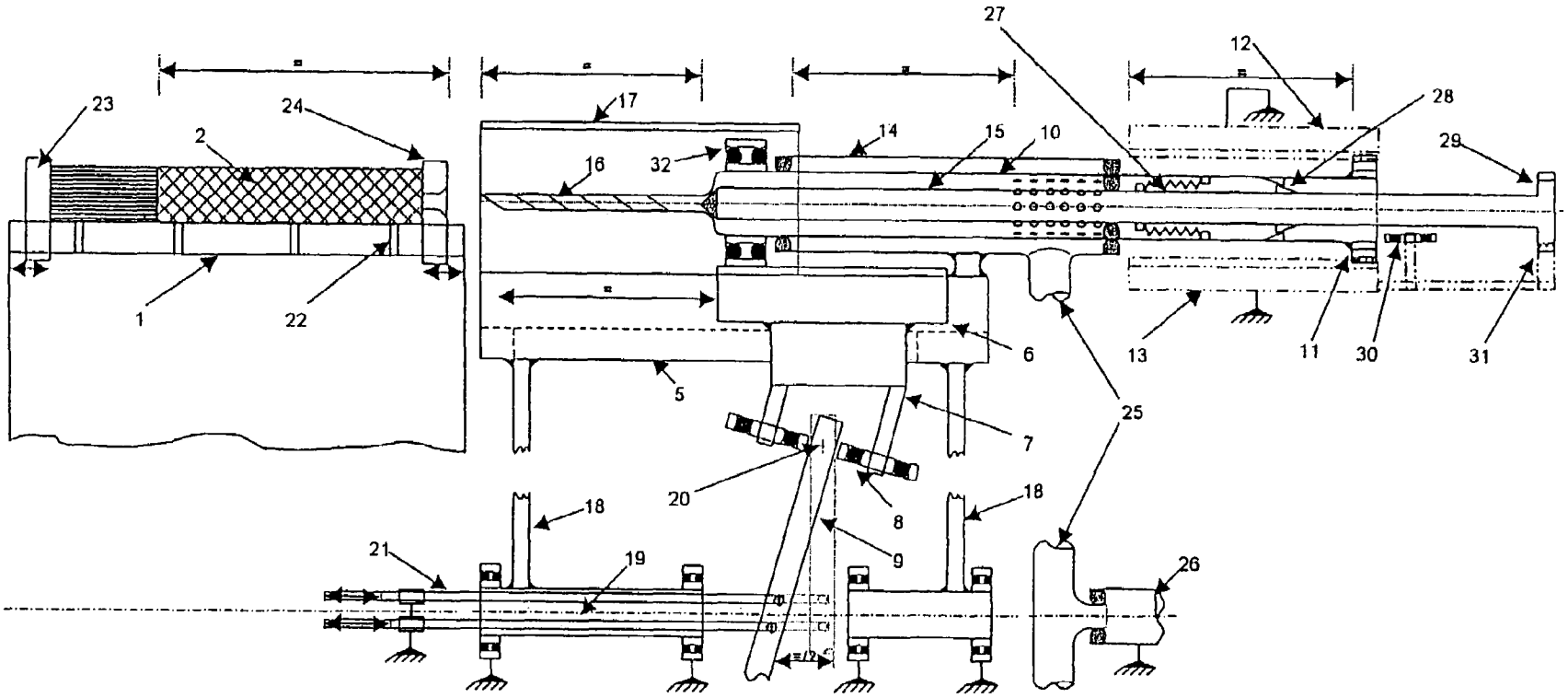
FIG. 1 shows an axial section through a device for supplying a flavor material to a filter cigarette using the appropriate operating means.

FIG. 1 shows, in an axial section, an embodiment of the device in accordance with the invention for supplying a flowable medium to the tobacco of a smoking product.

The left side of FIG. 1 depicts the cigarette 2 which is held on the circumference of a drum 1 of a filter assembler by holding platelets 23 and 24. The cigarettes 2 lie in a recess and are held in the direction of the drum radius by a partial vacuum applied via the small holes 22.

Figure 2:
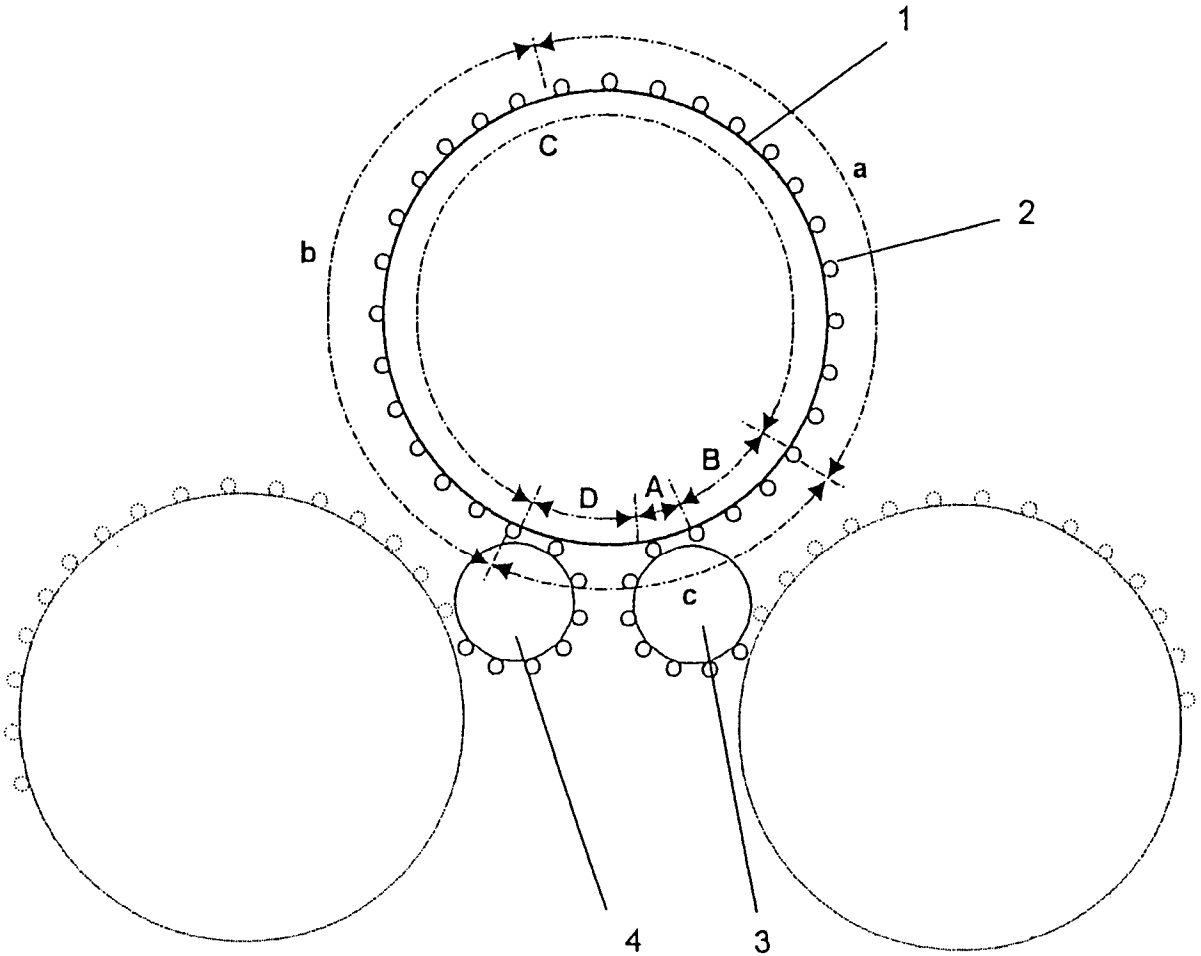
FIG. 2 shows a schematic cross-section through a number of drums in a filter assembler, including the drum on which the flavor is supplied.

In order to make said cigarette holding devices more comprehensible, reference will now firstly be made to FIG. 2 in which various drums of a filter assembler are shown schematically, wherein each drum delivers the cigarettes 2 to the next one. A number of cigarettes 2, held as described previously by a vacuum around the holding platelets 23, 24, are situated on the drum 1 of a conventional filter assembler shown in FIG. 1. The cigarettes 2 are delivered from a small delivery drum 3 onto the drum 1 and then again taken from the drum 4.

In the following description, the supply of the medium will be explained in yet more detail by way of the FIG. 1 in detail. In this respect, FIG. 2 shows where on the rotating drum 1 the cigarettes are situated during supply of the medium. The holding platelets 23, 24 arranged at the lit end and filter end (see FIG. 1) are not raised in the area A, and are not closed until the drum further rotates into area B. From here, the cigarettes are fixed at a predetermined location using the holding platelets 23, 24 and the vacuum 22. While passing through area C, the holding platelets remain closed, and only open again in area D to deposit the cigarettes onto the drum 4. In this way, the areas marked with capital letters on the inside of the drum define the status of the holding platelets.

The areas of the drum defined by lower case letters on the outside mark the status of supplying the medium in which the cigarettes are currently situated. Thus in area a, each hollow mandrel 16 (see FIG. 1) is inserted into the cigarette through a center hole in the holding platelet 24 at the lit end, up until just in front of the filter. In area b, the hollow mandrel is retracted and thereby injects a defined quantity of the medium, e.g. a flavor or a flavor liquid, into the rod of the cigarette 2. In area c, the hollow mandrel is completely retracted.

Returning now to FIG. 1 and to the group of components on the right hand side there, it may be recognized that the application device in accordance with the invention comprises a hollow mandrel 16 which stands out in front of an application body 10. The medium is injected into the cigarette through this hollow mandrel 16. The hollow mandrel 16 is rotatably supported about its own axis together with the application body 10, and at the front of the bed 32. The hollow mandrel 16 has screw-like grooves, so as not to move the tobacco stick in relation to the surrounding cigarette paper during insertion or extraction. In this respect, the hollow mandrel 16 rotates in opposite directions when inserted into and extracted from the tobacco rod, such that neither a rimming effect nor end outage occur. The hollow mandrel 16 is firmly connected to application body 10 and the gearwheel 11 at its rear end, wherein the function of the final gearwheel 11 will yet be explained in more detail. Only the rotational freedom of the group of components is ensured by the bed 32.

Via the bed 32, the application body sits rotatably on a sliding part 6, and the unit formed from the application body 10, the hollow mandrel 16, and the gearwheel 11 can be moved axially, together with the sliding part 6, in an elongated hole in the drum 5. The drum 5 is a carrier drum for the application units, and the elongated hole support which the axial movement of the application bodies 10 allows will be explained later in more detail by referring to FIG. 3.

The guide 7 for the sliding part 6, having fitted guidance beds 8 between which a fixed, inclined plate 9 is situated, runs through the elongated hole in the drum 5.

If the carrier drum 5 now rotates, the guidance beds 8 on the fixed, inclined plate roll off and, after each of the rolled-off sections of the plate are rotated and removed, move the application bodies on the sliding part 6 nearer to and/or further into or out of the cigarette 2. The status of being completely withdrawn from the cigarette 2 is shown in FIG. 1. By rotating the carrier drum 5, the drum 1 being rotated completely synchronously, rolling off on the inclined plate 9 in the non-rotational co-ordinate system only generates an axial insertion movement of the hollow mandrel 16 into and out of the cigarette. As already explained previously, the medium is applied into the rod of the cigarette 2 by withdrawing the hollow mandrel 16. The withdrawing movement should therefore be uniform in order to ensure a good distribution of the medium. It is particularly advantageous in this respect if the hollow mandrel 16 is inserted into the cigarette 2 very rapidly and relatively slowly withdrawn from it, and this configuration may be set by forming the inclined plate 9 not as a flat plate but as a cam plate.

As already mentioned above, the application body 10 and the hollow mandrel 16 rotate about their own axis when entering and exiting, in order to avoid a rimming effect during insertion and end outage during extraction. These rotations are in respectively opposite directions, and for the aforementioned purpose the hollow mandrel 16 also comprises the screw-like grooves shown on its outer side. Amongst other things, generating the aforementioned rotational movement will now also be explained in the following by referring to FIG. 3.

Figure 3:
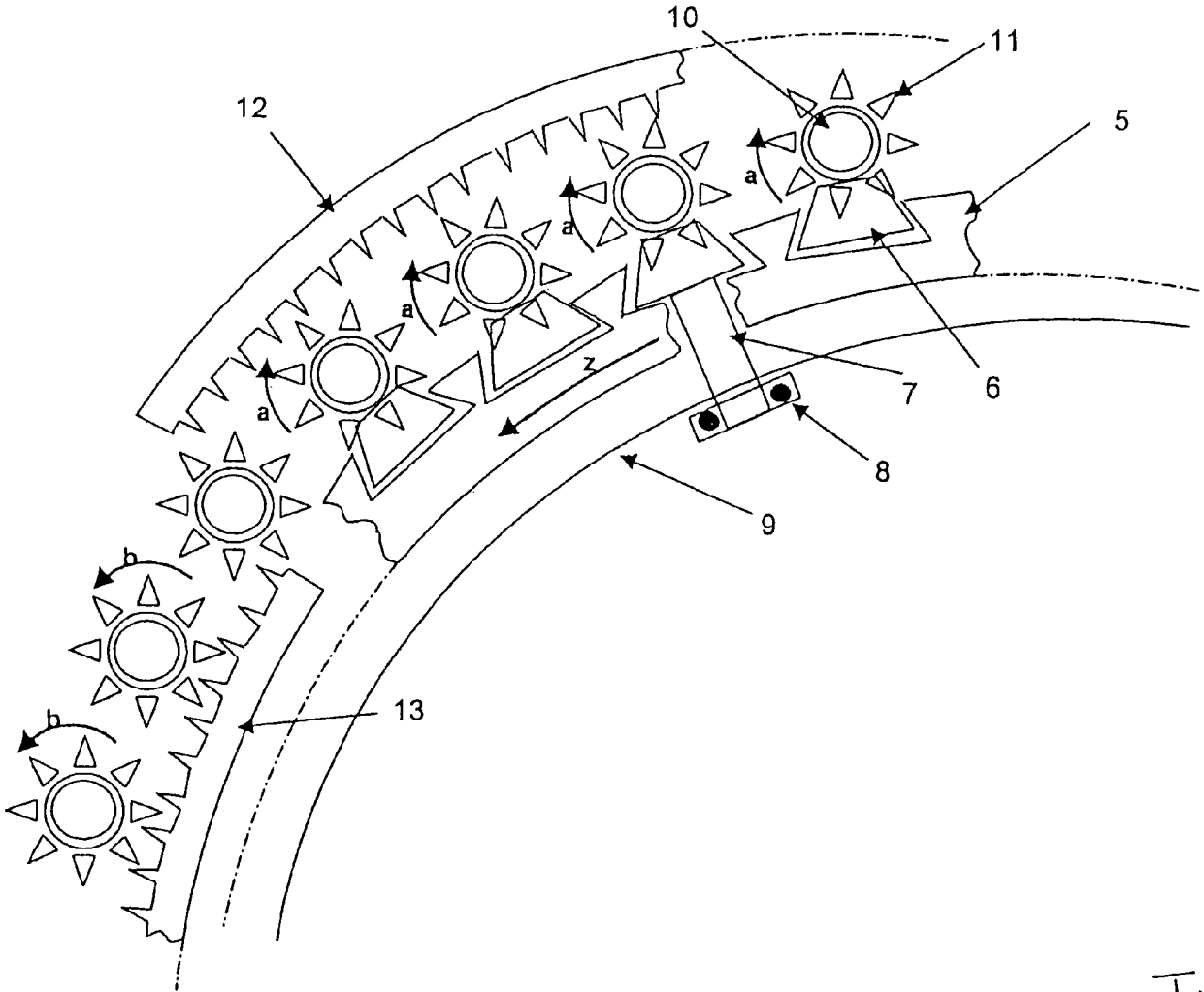
FIG. 3 shows a segment cross-section of a carrier drum for the hollow mandrels of the device in accordance with the invention.

The carrier drum 5 may be seen in FIG. 3 in a view from the right hand side of FIG. 1. The application bodies 10 are mounted on the carrier drum 5 in such a way that they can still be axially shifted on the drum 5 by means of the sliding parts 6. In this respect, the drum 5 rotates in the direction z with exactly the same speed as the drum 1 (FIGS. 1 and 2). The sliding parts 6 have a guide 7 with two beds 8, arranged through an elongated hole in the drum 5 in such a way that the two beds exhibit a space between each other. While the drum rotates, said beds roll off on the fixed, inclined plate. By skillfully choosing the inclination of the plate, the sliding parts 6 with the fitted application bodies 10 are axially moved once forward and back again by the beds rolling off.

The application bodies 10 possess the gearwheel 11 already mentioned previously, at the end facing the cigarette. While the drum rotates, said gearwheel 11 runs off on a fixed, outer gearwheel ring segment block 12, such that auto-rotation a of the application bodies 10 arises. The gearwheel segment 12 is arranged in such a way that covers the area a described above. Area b is covered by an inner gearwheel segment 13 in such a way that the application bodies 10 rotate in the opposite direction as a result. Area c does not possess a gearwheel and therefore does not injectively rotate, since in this area the hollow mandrel 16 is not situated in the rod of the cigarette 2. As likewise already mentioned above, it is advantageous to not form the plate 9 level, in order to achieve rapid insertion and extraction and in order to keep the sliding parts 6 completely retracted in area c.

In order that the liquid medium reaches the application body 10, the latter is guided in a sleeve 14 firmly mounted on the carrier drum 5. The medium is guided in the sleeves via radially arranged conduits 25, in such a way that a section of pipe 26 in the rotational axis of the drum unit 1 and 5 can deposit the liquid without leaking. The medium passes through openings in the form of rows of holes or elongated holes in the rotating application body 10, from the sleeve 14 which is fixed relative to the application body, and to the hollow mandrel 16. The sections of gearwheel segment 12 and 13 required for rotating the application bodies 10 are also indicated in FIG. 1.

The advance of the hollow mandrel 16 is dependent on the length of the tobacco stick and is indicated a number of times in FIG. 1 (=). The length of this advance constructively predetermines the length of the hollow mandrel 16, the path of the sliding part 6 on the drum 5, the length of the sleeve 14 and the breadth of the gearwheel segment 12 and 13. Correspondingly free pathways and therefore the arrangement and position of the respective gaskets are likewise indicated in FIG. 1.

The feeding of the medium into the cigarette on schedule is ensured by a valve unit 15. This valve 15 rotates with the application body 10 and also moves axially with it. An opening near the beginning of the constriction to the hollow mandrel 16 is opened and closed by an inner spring 27 and a mechanism 28 functionally similar to a ball point pen. This is caused to open, and the flavor thus caused to start to flow, by a firmly mounted bed 30 against which a gear rim plate 29 of the valve 15 pushes, just before reaching the front point of the hollow mandrel 16 in the cigarette 2, and retracts and locks the mechanism 28 against the force of the spring 27.

When the hollow mandrel 16 is just about to leave the cigarette 2 again, a fixed catch 31 meshes with the gear rim plate 29 such that the mechanism 28 abruptly releases its lock, and the spring 27 presses the valve. 15 forwards again to the constriction of the hollow mandrel and thus stops the flow of the medium.

Another, additional mechanism advantageously appears which can place the plate 9 in a quasi-vertical position. This has the advantage that all hollow mandrels can be immediately retracted to a protected position when the machine stops. To this end, a parallel guide 21 in the rotational axis 19 of the drums 5 and 1 is required which can rotate the plate 9 around the point 20. This relative movement may be taken into account when constructing the guide 7 with fitted beds 8.

As far as the choice between supplying the medium using a pump or using rotation is concerned, this choice can be made according to each application. If the rotational forces of the drums are sufficient to accelerate the media situated in the radially arranged conduits 25 such that they generate a sufficient pressure to apply enough medium to the cigarettes, then at higher speeds even more medium will automatically be supplied by the higher centrifugal forces and the more rapid extraction can be compensated for by higher pressure. In this way, the costly pumping and control unit may be dispensed with. Even here, however, various mechanical ways of setting are conceivable.

As far as the hollow mandrel is concerned, using hardened and high-strength materials is to be recommended, wherein the smallest diameter possible may be ascertained by a series of experiments. A self-cleaning cycle can also possibly be provided. In order to protect the delicate hollow mandrels, said hollow mandrels may be retracted to a protective hood 17 encompassing the drum, when the inclined plate 9 is retracted to a vertical position as already mentioned above.

Figure 4:
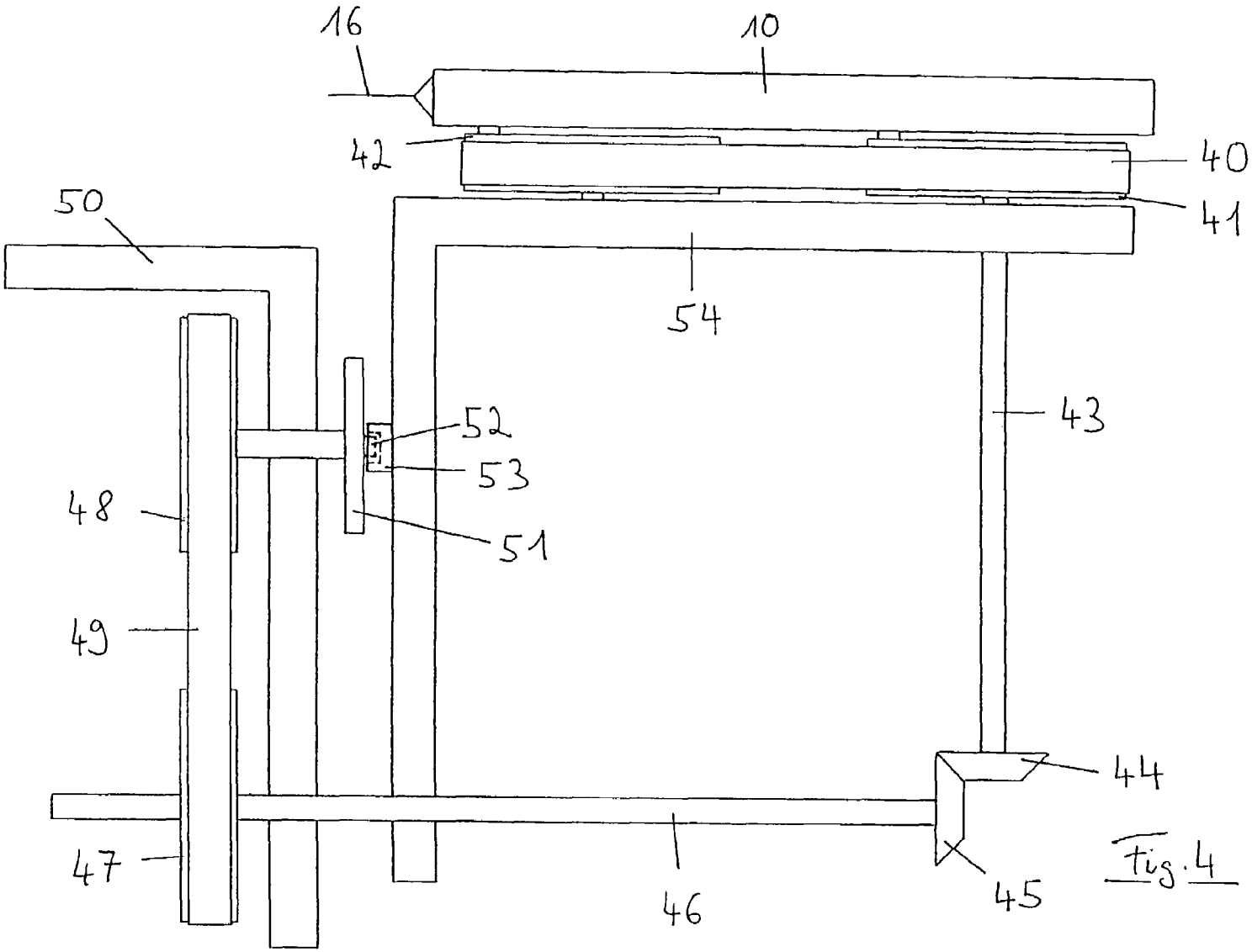
FIG. 4 shows an axial and radial movement means for the application device in accordance with the invention, in an embodiment differing from that in FIG. 1.
Figure 5:
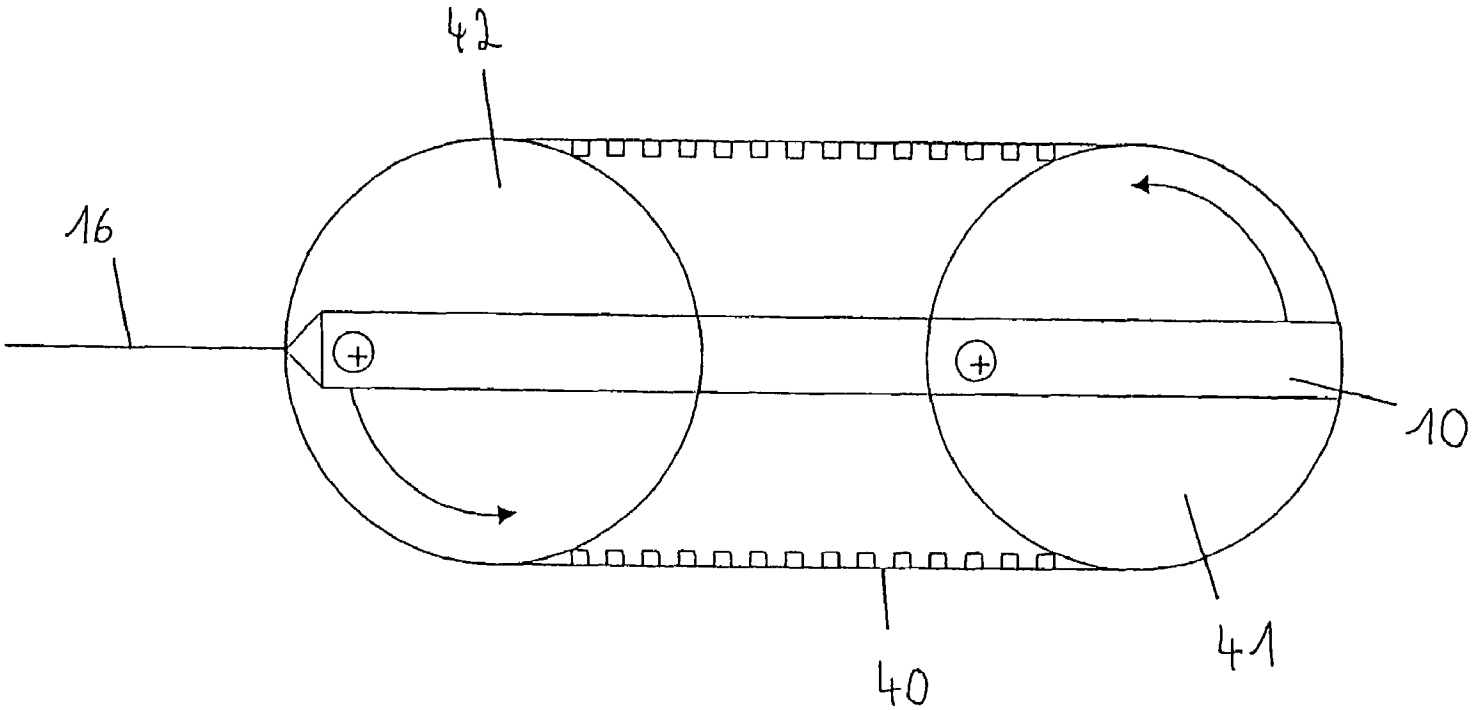
FIG. 5 shows the belt drive device for the hollow mandrel from FIG. 4, in a top view.

FIGS. 4 and 5 show a further way of providing the movement for the application body 10 with the hollow mandrel 16. As may easily be seen in the top view in FIG. 5, the application body 10 sits at two eccentric points on the two pulleys 41 and 42, around which a toothed belt runs which transfers the direct drive of the pulley 41 via the shaft 43 to the pulley 42. Through such a drive, the application body 10 with the hollow mandrel 16 would move in a circle with a fixed axis. In order to translate this circular movement into a purely axial to-and-fro movement, the two pulleys 41 and 42 sit on a holding device 54 which is moved such that the lateral movements generated perpendicular to the axis of the hollow mandrel are compensated for. Compensation is achieved via the main drive shaft 46 which is meshed and synchronized via its bevel wheel 45 with the bevel wheel 44. Behind the machine holding device 50, the shaft 46 runs through a pulley 47 which is non-rotatably arranged and drives a pulley 48 via the toothed belt 49, said pulley 48 in turn rotating the cam plate 51 via a small shaft (not shown). A rotating cam web 52 is fitted on the cam plate 51, said cam web 52 being recognizable in the cross-section only by two markings. The guidance part 53, also fastened to the holding device 50 of the injection device, meshes via the web as shown schematically in FIG. 4. The mesh is only shown at the upper end here for reasons of clearer presentation; if the movement of the application body 10 perpendicular to the axis is to be compensated for, then the pulley 48 and the cam plate 51 will mesh at about the height of the shaft. In this way, axial movement of the application body may also be achieved through such a device comprising pulleys and cam guidings.

It should also be noted in general that there exists in the embodiments shown the possibility of also providing a hollow mandrel 16 for every cigarette position on the drum 1. It is, however, also possible to work with only a limited number of hollow mandrels which is smaller than the number of cigarette positions on the drum 1. For example, only a quarter of the positions could be fitted with hollow mandrels, which would then be arranged on an arc segment of 90°. In the case of a drum with 40 cigarette positions, 10 hollow mandrels would therefore be provided for applying the media.

This arrangement of hollow mandrels moves with the cigarettes over a certain range of the movement of the drum (for example, less than 90°, such as 60°). At this time, the hollow mandrels are stuck into the cigarettes and withdrawn again. The medium is applied as the hollow mandrels are withdrawn. Then the arrangement of hollow mandrels moves relative to the movement of the cigarettes/drum, to return to its initial position again after a given amount of time. This cycle of the arrangement of hollow mandrels requires exactly the amount of time which is necessary to rotate the drum 1 holding the cigarettes by 90° in the example cited. This ensures that the medium is applied to every cigarette situated on the drum.

What is claimed is:

1. A method for supplying a flowable medium to a tobacco rod of a smoking product (2), comprising the steps of:

forming a cigarette rod on a cigarette machine; and introducing said flowable medium to said tobacco rod on a drum (1) of said cigarette machine, said flowable medium being introduced into the rod of the smoking product by a hollow mandrel (16) provided with screw-like outer grooves, by inserting the hollow mandrel (16) into a front end and discharging the medium from the hollow mandrel while withdrawing it from the rod, said hollow mandrel exhibiting auto-rotation in opposite directions upon insertion and upon extraction from said rod.

2. The method as set forth in claim 1, wherein the flowable medium is introduced as a material selected from the group of: liquid, pasty, powdery, filiform or gaseous medium.

3. The method as set forth in claim 1, wherein the hollow mandrel (16) is moved at a uniform speed with respect to the rod when introducing the medium, allowing distribution of the medium over the rod.

4. The method as set forth in claim 1, wherein the medium is introduced on the drum (1) of a filter assembler of a cigarette machine.

5. The method as set forth in claim 1, wherein the hollow mandrel (16) is held on a carrier drum (5) rotating synchronously with the drum (1).

6. The method as set forth in claim 5 wherein the flowable medium is supplied to the hollow mandrel (16) by the rotational centrifugal forces of the rotating carrier drum (5).

7. The method as set forth in claim 6 wherein the flow of the medium is regulated by a valve.

8. The method as set forth in claim 5 wherein the flowable medium is supplied to the hollow mandrel (16) by a pump.

9. A method for supplying a flowable medium to a tobacco rod of a smoking product, comprising the steps of:

forming said tobacco rod on a drum of a cigarette machine;

inserting a rotatable hollow mandrel provided with screw-like outer grooves into an end of said tobacco rod; and injecting said flowable medium from said hollow mandrel into said tobacco rod as said hollow mandrel passes through said tobacco rod.

10. The method of claim 9, wherein said flowable medium is introduced on said drum of said cigarette machine by inserting said hollow mandrel into an end of said tobacco rod, thrusting said hollow mandrel through said tobacco rod to a filter end of said tobacco rod, and injecting said flowable medium from said hollow mandrel.

11. The method of claim 10, including injecting said flowable medium from said hollow mandrel while withdrawing said hollow mandrel from said tobacco rod.

12. A method for supplying a flowable medium to a tobacco rod of a smoking product, comprising the steps of:

forming said tobacco rod; and introducing said flowable medium into said tobacco rod on a drum of a cigarette machine by inserting a hollow mandrel into an end of said tobacco rod and injecting said flowable medium from said hollow mandrel while withdrawing said hollow mandrel from said tobacco rod, wherein said hollow mandrel is provided with spiraled outer grooves providing an auto-rotation in opposing directions when said hollow mandrel is inserted into said tobacco rod and withdrawn from said tobacco rod.

13. The method of claim 12, wherein said medium is introduced as a material selected from the group of liquid, paste, powder, filiform, or gaseous medium.

14. The method of claim 12, wherein said medium is introduced on said drum of a filter assembler of said cigarette machine.

15. The method of claim 12, wherein said medium is introduced into said tobacco rod by inserting said hollow mandrel into a front end of said tobacco rod, said front end opposing a filter end.

16. The method of claim 15, wherein said hollow mandrel is moved at a uniform speed with respect to said tobacco rod during withdrawal of said hollow mandrel when introducing said medium, allowing uniform distribution of said medium over said tobacco rod.

17. The method of claim 15, wherein said hollow mandrel is held on a rotating carrier drum rotating synchronously with said drum.

18. The method of claim 17, wherein said medium is supplied to said hollow mandrel by a pump.

19. The method of claim 17, wherein said medium is supplied to said hollow mandrel by rotational centrifugal forces of said rotating carrier drum.

20. The method of claim 19, wherein said medium flow is regulated by a valve.

21. A method for introducing a flowable medium to a formed tobacco rod of a smoking product on a drum of a cigarette machine, comprising the steps of:

inserting a rotatable hollow mandrel provided with spiraled outer grooves into an end of said formed tobacco rod;

driving said hollow mandrel to an opposing filter end of said formed tobacco rod; and injecting said flowable medium from said hollow mandrel, while said hollow mandrel passes at a uniform speed through said formed tobacco rod, allowing uniform distribution of said flowable medium over said formed tobacco rod, said hollow mandrel being inserted into said formed tobacco rod and extracted from said formed tobacco rod with auto-rotation in opposite directions for insertion and extraction.

22. The method of claim 21, wherein said flowable medium is selected from the group of: liquid, pasty, powdery, filiform, or gaseous medium.

23. The method of claim 21, wherein said flowable medium is introduced on said drum of a filter assembler of said cigarette machine.

24. The method of claim 21, wherein said flowable medium is injected into said formed tobacco rod of said smoking product while said hollow mandrel is withdrawn.

25. The method of claim 24, wherein said hollow mandrel is held on a carrier drum rotating synchronously with said drum.

26. The method of claim 25, wherein said flowable medium is supplied to said hollow mandrel by rotational centrifugal forces of said carrier drum and said medium flow is regulated by a valve.

27. The method of claim 25, wherein said flowable medium is supplied to said hollow mandrel by a pump.

28. A method for supplying a flowable medium to a formed tobacco rod of a smoking product, comprising the steps of:

introducing said flowable medium by inserting a rotatable hollow mandrel provided with spiraled outer grooves into an end of said formed tobacco rod while said formed tobacco rod is positioned on a drum of a cigarette machine;

driving said hollow mandrel to an opposing filter end of said formed tobacco rod; and injecting said flowable medium while withdrawing said hollow mandrel from said formed tobacco rod, said hollow mandrel being inserted into and extracted from said formed tobacco rod with auto-rotation in opposite directions for insertion and extraction.

29. The method of claim 28, wherein said medium is selected from the group of: liquid, pasty, powdery, filiform, or gaseous medium.

30. The method of claim 28, wherein said hollow mandrel is inserted and extracted at a consistent speed for even distribution of said flowable medium over said formed tobacco rod.

31. The method of claim 28, wherein said flowable medium is introduced on a drum of a filter assembler of said cigarette machine.

32. The method of claim 31, wherein said hollow mandrel is held on a rotating carrier drum rotating synchronously with said drum.

33. The method of claim 32, wherein said flowable medium is supplied to said hollow mandrel by a pump.

34. The method of claim 32, wherein said flowable medium is supplied to said hollow mandrel by rotational centrifugal forces of said rotating carrier drum.

35. The method of claim 34, wherein said medium flow is regulated by a valve.

* * * * *